United States Patent [19]

Dinella et al.

[11] 4,098,922

[45] Jul. 4, 1978

[54] METHOD FOR DEPOSITING A METAL ON A SURFACE

[75] Inventors: Donald Dinella, Berkley Heights; John Allen Emerson, Alexandria Township, Hunterdon County; Ted Dennis Polakowski, Jr., Fairview, all of N.J.

[73] Assignee: Western Electric Company, Inc., New York, N.Y.

[21] Appl. No.: 693,600

[22] Filed: Jun. 7, 1976

[51] Int. Cl. ..... B44d 1/18

[52] U.S. Cl. ..... 427/54; 427/55; 427/97; 427/98; 427/304; 427/305; 427/306

[58] Field of Search ..... 427/43, 54, 55, 56, 427/97, 98, 290, 292, 304, 305, 306, 229; 106/1; 96/48 PD; 204/38 B; 423/366

[56] References Cited

U.S. PATENT DOCUMENTS

| | | | |
|---|---|---|---|
| 2,880,153 | 3/1959 | Hiltz et al. | 96/115 P X |
| 3,772,078 | 11/1973 | Polichette et al. | 427/35 X |
| 3,904,783 | 9/1975 | Nara et al. | 427/54 |
| 3,930,963 | 1/1976 | Polichette et al. | 427/97 X |

OTHER PUBLICATIONS

Kosar, Light Sensitive Systems, 1965, pp. 29–31, 187, 188.

Wein, Samuel, "Sensitizing–A Process Used in Silvering" *The Glass Industry,* Jul. 1954.

*Primary Examiner*—Bernard D. Pianalto

*Attorney, Agent, or Firm*—J. Rosenstock

[57] ABSTRACT

A method for depositing a metal on a surface is disclosed. The method comprises coating the surface with a sensitizing solution comprising at least a reducible salt of a non-noble metal dissolved in a solvent comprising water and an alcohol having a total number of carbon atoms ranging from 2 to 8. The coated surface is treated to reduce the metal salt to metallic nuclei to form a catalytic layer thereon capable of directly catalyzing the deposition of a metal on said nuclei from an electroless metal deposition solution.

53 Claims, 4 Drawing Figures

FIG. 1
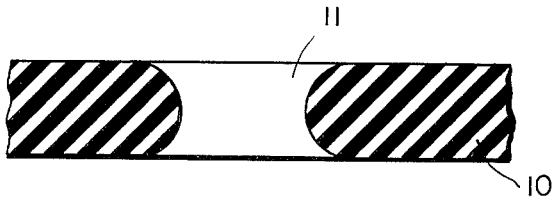
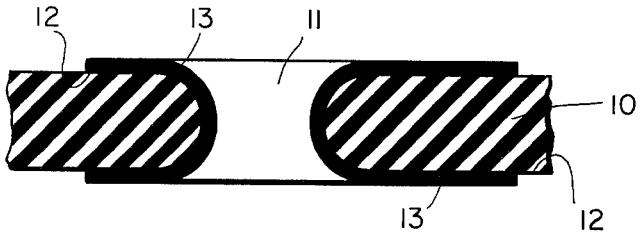
FIG. 2
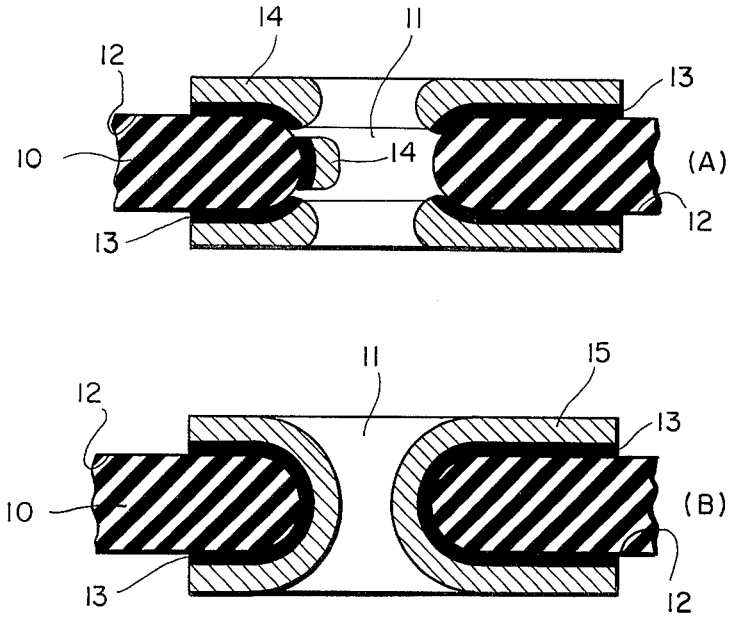
FIG. 3

METHOD FOR DEPOSITING A METAL ON A SURFACE

BACKGROUND OF THE INVENTION

1. Field of the Invention

This invention relates to a method of depositing a metal on a surface and more particularly, to a method of selectively depositing an electroless metal deposit on a surface.

2. Discussion of the Prior Art

Heretofore, it has been known to employ a number of pretreatment or sensitization baths in effecting the electroless deposition of metals on various surfaces. Typically, such prior art sensitization baths used commercially have been expensive because they depend upon a noble metal, e.g., Pd, Pt, Ag, Au, etc., as the sensitizing component. However, recently methods have been reported in which electroless metal deposits can be applied to a broad variety of insulating substrates without the need to use expensive noble metals but on the contrary, employ reducible salt compositions of non-noble metals. U.S. Pat. Nos. 3,772,056; 3,772,078; 3,907,621; 3,925,578; and 3,930,963 disclose such methods. A problem with the methods disclosed in these patents and not recognized or addressed thereby or therein is that of humidity which affects the resultant electroless metal deposit. Also, another problem not recognized or addressed is that when a substrate has an aperture typically represented by the apertured printed wiring board substrate, a discontinuous electroless metal deposit is obtained on the walls of the aperture. Accordingly, a method of eliminating these problems is needed and is an object of this invention.

SUMMARY OF THE INVENTION

A method of depositing a metal on a surface includes coating the surface with a sensitizing solution comprising at least a reducible salt of a non-noble metal dissolved in a solvent comprising water and an alcohol having a structural formula of

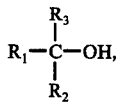

where $R_1$, $R_2$ and $R_3$ are members selected from the group consisting of an alkyl group having 1 to 7 carbon atoms and the hydrogen atom, where the alcohol has a total of 2 to 8 carbon atoms. The coated surface is then treated to reduce the metal salt to metallic nuclei to form a catalytic layer thereon capable of directly catalyzing the deposition of a metal on the nuclei from an electroless metal deposition solution.

DESCRIPTION OF THE DRAWINGS

The present invention will be more readily understood by reference to the following drawing taken in conjunction with the detailed description, wherein:

FIG. 1 is a cross-sectional view of a substrate having an aperture therein;

FIG. 2 is a cross-sectional view of the substrate of FIG. 1 which has deposited thereon a real image capable of participating in an electroless metal deposition catalysis; and FIGS. 3(A) and (B) are cross-sectional views of the substrate of FIG. 2 which have deposited thereon an electroless metal deposit.

DETAILED DESCRIPTION

The present invention will be discussed primarily in terms of selectively depositing copper on a surface of an apertured substrate. It will be readily appreciated that the inventive concept is equally applicable to depositing other suitable metals which are catalytically reduced from their respective ions by the catalytic surface areas produced by the subject invention. It will also be appreciated that the selective deposition is not limited to any one particular type of surface but is applicable to metallizing any surface whether used as a printed circuit board or not.

The present invention relates to imposing by (1) thermal energy, (2) radiant energy or (3) chemical reduction methods, sensitive, non-conductive metallic areas on the surfaces of a substrate which catalyze the deposition of strongly adherent and continuous deposits of electroless metal. U.S. Pat. Nos. 3,772,056; 3,772,078; 3,907,621; 3,925,578; and 3,930,963, all of which are incorporated hereinto by reference, disclose a method of selectively metallizing a surface by coating with a composition comprising at least a reducible salt of a non-noble metal selected from copper, nickel, cobalt or iron, which is then converted to electrically non-conductive metal nuclei capable of catalyzing the deposition thereon of a metal from an electroless metal deposition solution. However, when a surface has an aperture therein, it has been found that the method disclosed in the above-identified patents, incorporated by reference hereinto, does not successfully work in that the electroless metallization of the walls of the aperture becomes discontinuous, i.e., the resultant metal deposit thereon has voids. This problem is obviated when the reducible salt is contained in a solvent carrier comprising a mixture of water and an organic alcohol. The use of a solvent mixture is critical and in this regard, a criticality has also been found in that the alcohol must contain at least 2 carbon atoms.

It is also to be noted that where an aperture is present, the use of the solvent mixture enables the conversion of the reducible salt contained within the aperture to occur at the same rate at the same energy intensity level (heat, radiant), which is also directed at other areas of the surface.

Referring to FIG. 1, a suitable substrate 10 is first selected. Typical suitable substrates include bodies comprising inorganic and organic substances, such as glass, ceramics, porcelain, resins, paper, cloth and the like. Metal-clad or unclad substances of the type described may be used.

For printed circuits, among the materials which may be used as the bases, may be mentioned metal-clad or unclad insulating thermosetting resins, thermoplastic resins and mixtures of the foregoing, including fiber, e.g., fiberglass, impregnated embodiments of the foregoing.

Included in the thermoplastic resins are acetal resins; acrylics, such as methyl acrylate; cellulosic resins, such as ethyl cellulose, cellulose acetate, cellulose propionate, cellulose acetate butyrate, cellulose nitrate, and the like; polyethers; nylon; polyethylene; polystyrene; styrene blends, such as acrylonitrile styrene and copolymers and acrylonitrile-butadiene styrene copolymers; polycarbonates; polychlorotrifluoroethylene; and vinyl polymers and copolymers, such as vinyl acetate, vinyl alcohol, vinyl butyral, vinyl chloride, vinyl chloride-acetate copolymer, vinylidene chloride and vinyl formal.

Among the thermosetting resins may be mentioned allyl phthalate; furane; melamine-formaldehyde; phenol formaldehyde and phenolfurfural copolymers, along or compounded with butadiene acrylonitrile copolymers or acrylonitrile-butadiene-styrene copolymers; polyacrylic esters; silicones; urea formaldehydes; epoxy resins; allyl resins; glyceryl phthalates; polyesters; and the like.

Porous materials, comprising paper, wood, fiberglass, cloth and fibers, such as natural and synthetic fibers, e.g., cotton fibers, polyester fibers, and the like, as well as such materials themselves, may also be metallized in accordance with the teachings herein. The invention is particularly applicable to the metallization of resinimpregnated fibrous structures and varnish-coated, resinimpregnated fiber structures of the type described.

Where radiant energy, such as ultraviolet radiation, is to be employed, preferred substrates are opaque to the transmission of radiant energy. This prevents "printing through" and also facilitates simultaneous or sequential formation of images and circuits on both major surfaces of the board. The substrate surfaces can be rendered opaque to light energy mechanically, i.e., by frosting with sandblasting and the like, or chemically by etching with appropriate reagents, such as chromic acid for resins and hydrogen fluoride for glass, alkali for porcelain, and the like. Frosted surfaces will scatter rather than absorb incident energy. On the other hand, energy absorbing substances can be dispersed in the substrate or adsorbed on the surface thereof to render the substrate opaque. By way of illustration, pigments, such as carbon black and titanium dioxide, are useful to prevent penetration by light in the visible wavelengths; bismuth, tin, lead and thorium compounds, as well as organic iodine compounds are useful as X-ray radiation and electron barriers. Lead compounds are useful neutron shields. The substrate can be rendered opaque to light energy, particularly at visible or ultraviolet wavelengths with a conventional compound, such as a hydroxy benzophenone, a hydroxy benzotriazole or a substituted acrylate, and the like.

Substrate 10 contains an aperture or through hole 11, typically on the order of 0.010 inch to 0.200 inch in diameter in the production of printed circuit boards. Referring to FIG. 2, a surface 12 of substrate 10 is selectively deposited with an electrically non-conductive layer or real image 13 comprising nuclei of a metal which is capable of catalyzing the deposition of electroless metal from an electroless metal deposition solution with which it is destined to be exposed or treated.

Real image 13 comprises metallic nuclei in which the metals are selected from Groups VIII and IB of the Periodic Table of Elements. Preferred metals are selected from Period 4 of Groups VIII and IB; iron, cobalt, nickel and copper. Especially preferred for the production of real image 13 is copper.

If desired, surface 12 can be coated with an adhesive before being coated with the compositions of this invention.

In producing real image 13, the metal is reduced from its salt or a composition of the salt in situ in selected areas on surface 12 of substrate 10 by application of radiant energy, e.g., thermal or light, such as ultraviolet light and visible light, X-rays, electron beams, and the like, or by treatment with a chemical reducing agent.

The reducible metal salt can comprise, in general, a cation selected from the metals of Group VIII and IB of the Periodic Table of the Elements. The anion associated in such metal salts can vary widely and can comprise organic and inorganic anions such as halides, sulfates, nitrates, formates, gluconates, acetates and the like. The cations in such salts will include copper, nickel, cobalt and iron, in any of the usual degrees of oxidation, e.g., both cuprous and cupric, ferrous and ferric, etc., will serve. Some typical salts include cupric formate, cupric gluconate, cupric acetate, cupric chloride, cupric nitrate, nickel chloride, cobalt chloride, ferrous sulfate and cobalt chloride.

In one manner of proceeding, a sensitizing solution comprising a heat-reducible metal salt, e.g., cupric formate, and optionally a developer, e.g., glycerine, and a surfactant in a suitable solvent, is selectively coated onto surface 12, dried and heated, e.g., at 100° to 170° C., preferably at 130° to 140° C., until the metallic salt has been reduced to non-conductive real image 13 comprising metallic nuclei, e.g., copper, nickel, cobalt or iron nuclei. A suitable solvent is one comprising a mixture of water and an alcohol having a structural formula of

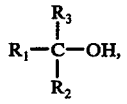

where $R_1$, $R_2$, and $R_3$ are members selected from the group consisting of an alkyl radical having 1 to 7 carbon atoms, and a hydrogen atom, where the alcohol contains a total of 2 to 8 carbon atoms, e.g., ethanol, propanol, n-butanol, octanol, etc. Image 13 on surface 12 is now catalytic to the deposition of electroless metal, e.g., copper, nickel, cobalt, gold or silver thereon, including the walls of through hole 11. Alternatively, the entire surface 12 is provided with a layer (not shown) of the sensitizing solution and image 13 is formed by heating selected areas, as with a hot die.

In more detail, according to such a heatactivation process, surface 12, if necessary, is cleaned as described in the patents incorporated hereinto by reference. The clean surface 12 is printed in selected areas to delineate layer or image 13 with a metal salt sensitizing solution, for a short time, e.g., 1 to 3 minutes. Substrate 10 having layer 13 thereon is then placed in a heated area, e.g., an oven for 10 to 20 minutes, or until the metal salt is reduced to form the reduced or real image 13 comprising metallic nuclei. The selective printing may be done using any conventional printing technique such as stenciling, stamping, etc., or masking surface 12 followed by dip coating of the masked surface. The temperature of heating can range from 100° to 170° C., but the preferred range is 130° to 140° C. The reduction is considered completed when layer 13 has darkened in color. Substrate 10 with reduced real image 13 thereon is then removed from the heated area and allowed to cool. Reduced real image 13 is catalytic to electroless metal deposition and can be processed in known ways for the subsequent build-up of electroless metal plating and, optionally, a top layer of electroplating.

Alternatively, the entire surface 12 can be coated with a layer (not shown) of the metal salt sensitizing solution and reduced real image 13 produced by heating selected areas. Surface 12 is dip coated with a solution of heat reducible metal salt, e.g., cupric formate and, optionally, a developer, e.g., glycerine, and a surfactant in the solvent. Surface 12 is dried and is contacted directly with a heated object in those areas which are to be rendered catalytic to electroless metal by the reduction of the metal salt to catalytic nuclei. The heated object may be a metal surface which conforms exactly to surface 12. If a printed circuit is to be formed, a preformed die in the configuration of the circuit may be heated to a temperature of 100° to 170° C. and applied to the surface 12. When removed, a circuit pattern of catalytic nuclei will remain which may then be metallized to form a conductive circuit pattern. A heated scribe may also be used to thermally reduce the metal salt. To prevent sticking, the heated object may be coated with an anti-sticking agent such as polytetrafluoroethylene.

In another manner of proceeding, a sensitizing solution of a reducible metal salt composition, e.g., cupric formate, and a radiant energy-sensitive reducing agent contained in the suitable solvent, described above, is selectively printed on surface 12, dried and exposed to a source of radiant energy, e.g., an ultraviolet radiation source, to form reduced or real image 13 of metallic nuclei.

The radiant energy sensitive compound used in association with the reducible metal has the property of decomposing to a compound which will exercise a reducing action on the exposed metal salt. Such radiant energy-sensitive compounds form a family of scope well known to those skilled in the art. Among them may be mentioned ferric salts, dichromate compounds, anthraquinone and its compounds, amino acids, such as glycine, unsaturated organic compounds such as L-ascorbic acid, cinnamic acid, stilbenes, or azide compounds and the like. Because visible and ultraviolet light are the most convenient sources of radiant energy, the solutions used in this invention preferably contain such compounds which are sensitive to visible or ultraviolet light. Especially preferred are ferric salts, dichromates, anthraquinone and derivatives thereof. Illustrative among these are:

(a) ferric salts, such as ferric ammonium citrate (green or brown), ferric potassium citrate, ferric ammonium oxalate, ferric sodium oxalate, ferric potassium oxalate, ferric ammonium tartrate, ferric citrate, ferric oxalate, ferric chloride, ferric ammonium sulfate and the like;

(b) bichromate salts, such as those of the general formula $Me_2CrO_3.CrO_4$ wherein Me is any common metal cation, such as alkali metal, alkaline earth metal; ammonium or substituted ammonium, and the like. Some typical salts include sodium bichromate, potassium bichromate, or mixtures thereof with organic substances of animal or vegetable origin such as gelatin, fish glue, gum arabic, shellac, and the like, such as bichromated starch, and the like; and (c) anthraquinone or derivatives thereof, such as 9,10-anthraquinone, β-chloroanthraquinone, β-phenylanthraquinone, 1,2-benzanthraquinone, anthraquinone-2-sulfonic acid, anthraquinone-2,6 (or 2,7-)-disulfonic acid, salts thereof, and particularly anthraquinone 2,6-disodium sulfonate, anthraquinone-2,7-disodium sulfonate, anthraquinone-2,7-dipotassium sulfonate, and the like. Other useful radiant energy-sensitive compounds will suggest themselves to those skilled in the art, and a wide variety of such compounds are shown, for example, in standard reference works such as J. Kosar, *Light Sensitive Systems,* John Wiley & Sons, New York (1965).

A preferred additional ingredient in the treating composition is a secondary reducer, such as an organic, oxygen- or nitrogen-containing compound. Such an ingredient serves to facilitate interaction of radiant energy and the radiant energy-sensitive compound to provide a reduction of the metal salt to the free metal nuclei. Although the secondary reducer compound may be any oxidizable organic compound which is soluble in the solution, does not attack the base material, and is inert to the other ingredients, it is preferred that it comprise a hydroxy compound such as an alcohol or a polyol. Especially preferred as secondary reducing compounds are alcohols or polyols. Among the organic oxygenated compounds can be mentioned glycerol, ethylene glycol, pentaerythritol, mesoerythritol, 1,3-propanediol, sorbitol, mannitol, 1,2-butanediol, pinacol, sucrose, dextrin, polyethylene glycols, lactose, starch, gelatin, and the like. Also included are compounds such as triethanolamine and propylene oxide. Compounds which are also useful as secondary reducers are amino compounds, polyethers, certain dyestuffs and pigments. Among these may be mentioned aldehydes, such as formaldehyde, benzaldehyde; acetaldehyde; N-butyraldehyde, polyamides, such as nylon, albumin and gelatin; leuco bases of triphenylmethane dyes, such as 4-dimethylaminotriphenylmethane; leuco bases of xanthene dyes, such as 3,6-bisdimethylaminoxanthane and 3,6-bisdimethylamino-9-(2-carboxyethyl)xanthene; polyethers, such as ethylene glycol diethyl ether, tetraethylene glycol dimethylether, alizarin, erythiocin, phthalocyanine blue, zirconium silicate and the like.

It is to be pointed out here that when the polyol lactose is employed as a secondary reducer, the sensitizing solution is applied to surface 12 and is not dried prior to exposure to the source of light radiant energy such as ultraviolet radiation. Surprisingly, it has been found that the lactose does not function as a secondary reducer if surface 12 is dried prior to exposure to the source of light radiant energy. This is unexpected since U.S. Pat. Nos. 3,772,056; 3,772,078; 3,907,621; 3,925,578; and 3,930,963, incorporated hereinto by reference, teach that surface 12 must be dried prior to exposure to the radiant energy.

It is also to be pointed out hereat that where treated surface 12 of substrate 10 is allowed to age and/or is exposed to high-humidity conditions, real image 13 may not form thereon by exposure to radiant energy or if it does form, it may fade and disappear. It has surprisingly been found that such problems, due to aging and/or high-humidity exposure, can be eliminated by employing an image former and stabilizer comprising lactose, which is used in this capacity in addition to any other polyol which may be present in the sensitizing solution. The lactose, when used in combination with a secondary reducer, does not function as a secondary reducer but rather as the image former and stabilizer whereby real image 13 will form and will not fade or disappear upon prolonged standing or exposure to an ambient having a high-moisture content. This is especially true where surface 12 has been dried prior to exposure to the source of light radiant energy.

Additionally, other ingredients known as metal reduction intensifiers/accelerators/stabilizers may be added to the treating sensitizing solution to provide at least one of the following effects: (1) speed-up the exposure time, (2) help bring out image 13 and provide better contrast, (3) provide anti-fogging, (4) lead to better definition and (5) prevent image 13 from fading. The advantages provided by these additives, especially, are important advances in the art. For example, image formation can be accelerated; contrast can be improved, the need for the heat intensification can be eliminated and the stability of the image enhanced if to the solution comprising the metal salt and radiant energy-sensitive compound are added halogens, e.g., bromides and chlorides, alone or in combination with metals such as tin, alkali metals, mercury, germanium, titanium, molybdenum, rare earths, amines, ammonia and the like. Illustrative of such compounds are: hydrogen halides and alkali metal or alkaline earth metal halides, ammonia or amine halides and the like. Particularly preferred are stannous chloride, hydrogen chloride, hydrogen bromide, potassium chloride and potassium bromide. In some embodiments the recited compounds may be used with organic acids such as mono-, di-, tri-carboxylic acids or salts thereof and the like, for example, with acetic acid, citric acid, oxalic acid and the like.

A particularly effective additive has been found to be ferrithiocyanide compounds, e.g., potassium ferrithiocyanide, which surprisingly have reduced the typical exposure or imaging time by two-thirds.

In addition to the metal reduction image intensifiers-/accelerators/stabilizers, the composition comprising the metal salt and the radiant energy-sensitive compound can include also a surfactant, for those surfaces which are hard to wet with the particular sensitizing solution employed. The choice of the surfactant is not particularly critical, but usually it is preferred to use a non-ionic surfactant, because this permits a broader range in formulation. Among the suitable surfactants are polyethyleneoxy non-ionic ethers such as Triton-X 100, manufactured by Rohm & Haas Company, and non-ionic surfactants based on the reaction between nonylphenol and glycidol such as surfactants 6G and 10G manufactured by the Olin Company. Also suitable are fluorocarbon surfactants such as perfluorodecanoic acid and the series of related compounds manufactured by the 3M Company under the product designation FC-170 and the like.

The treating sensitizing solution may be formulated within broad concentration ranges, depending primarily on the relative amount of metal salt composition desired to be placed on surface 12, which in turn will depend on the mode of application, e.g., immersion, dip coating, roller coating, curtain coating, spraying and the like. In addition, the concentration of the ingredients in solution will be limited by solubility in the solvent. In general, the metal salt concentration will be predetermined and the amounts of radiant energy-sensitive compound and other ingredients, if present, will be adjusted to provide a ratio which will insure the desired result. This is well within the skill of those familiar with the art of formulating radiant energy sensitive systems. For example, at least enough radiant energy-sensitive compound will be present to facilitate substantially complete reduction by exposure to radiant energy of the metal salt to the free metal nuclei. Usually to insure complete reduction, a substantial excess of the radiant energy-sensitive compound (based on the reducible metal ions) will be present. The metal salt concentration in solutions can vary over wide limits, e.g., from 0.5 to 100 grams or more per liter can be used but it is most convenient and economical not to use more than about 25 grams per liter and preferably less than about 15 grams per liter. The radiant energy-sensitive compound can comprise from about 1 to 10 or more equivalents, based on the metal salt. The amount of the secondary reducer, e.g., glycerol, sorbitol pentaerythritol, dyestuff or the like, can likewise vary over a wide range, e.g., from 0.5 to 500 grams per liter, but in the case of difficult to volatilize liquid compounds, it is preferred not to include so much of such compounds that the treated surface is wet or sticky to the touch after drying. The ingredients, such as halide ions, stannous halides and carboxylic acids added to the compositions as image intensifiers, accelerators, stabilizers, etc., will generally be used in relatively low concentrations, e.g., from trace amounts, e.g., from about 1 mg. per liter up to about 2 grams per liter. The amount of ferrithiocyanide compounds ranges from 50 to 150 parts per million. Surfactants will be used in small, but conventional quantities, if present. The non-ionics will be used at levels from about 0.1 to 2 grams per liter and anionics from about 0.1 to 1.0 grams per liter.

Alternatively, instead of selectively printing, if surface 12 is coated all over with the metal salt sensitizing solution to form a sensitizing solution layer (not shown) and exposed through a positive or negative of an original pattern or photograph, there will form real image 13 on selected portions of the surface from which the background can be removed by washing out the unexposed (unreduced) portion of the sensitizing solution layer, e.g., in running water for about 5 to 10 minutes. Real image 13 on the surface 12 may then be reinforced by deposition of electroless metal from a solution onto the image so as to build up metal on surface 12 and on the walls of through hole 11.

In still another manner of proceeding, a sensitizing solution comprising a reducible metal salt, e.g., cupric formate, cupric gluconate, cupric acetate, cupric chloride, nickelous chloride, cobaltous chloride or ferrous sulfate, etc., in the suitable solvent described above, optionally containing glycerine and surface active agents, is selectively coated onto surface 12, dried and exposed to a chemical reducing agent, e.g., an alkali metal borohydride, e.g., sodium or potassium borohydride, an alkali metal hydrosulfite, e.g., sodium hydrosulfite, or an amine borane, e.g., dimethylamine borane or morpholine borane, in an aqueous or non-aqueous solvent, e.g., water or methanol, for about 1 to 2 minutes or until the formation of real image 13 comprising reduced metallic nuclei is complete. After surface 12 is rinsed free of chemical reagents, e.g., with water, image 13 is exposed to a solution for the deposition of electroless metal to build up metal on the surface 12 of the substrate 10 over image 13 including the walls of through hole 11. Alternatively, substrate 10 can be coated over its entire surface 12 with the sensitizing solution and then selectively exposed to the reducing agent to produce real image 13.

In more detail, in such a chemical reduction process, substrate 10, if necessary, is cleaned and roughened by methods described in the patents incorporated hereinto by reference. Substrate 10 is then selectively coated on surface 12 with a sensitizing solution, for a short time, e.g., 1 to 5 minutes, and allowed to dry. The drying rate is not critical but it is dependent on the method of drying and the temperature used. Temperatures above 170° C. are not preferred however.

In all cases coated surface 12 should be dry before selective exposure to radiant energy (except where lactose is primarily employed as a secondary reducer and not as an image former and stabilizer) and preferably dry before exposure to reducing agents, as the case may be. Otherwise, images may reverse. In all such embodiments, the metal accelerators described above will provide enhanced rates of image formation.

Surface 12, having a layer of the dry sensitizing composition thereon, is next immersed into a chemical reducing solution, e.g., sodium borohydride solution, for about 1 to 2 minutes or until the base is substantially darkened in color. This indicates that the metal salt has been reduced to real image 13, comprising free metal nuclei, e.g., copper, nickel, cobalt or iron, which is now catalytic to the deposition of electroless metal.

Referring to FIGS. 2 and 3(A), (B), upon formation of catalytic real image 13, substrate 10 is rinsed in running water for a short time, e.g., 3 to 5 minutes, and is then immersed in a suitable electroless metal deposition solution to deposit an electroless metal deposit on image 13. It is to be pointed out and stressed hereat that the solvent employed to form the sensitizing solution comprising at least the reducible salt of the metal selected is critical. Where radiant or thermal energy is employed, if water alone or alcohol alone is employed, real image 13 will not be uniformly formed and a higher energy intensity exposure of the walls of through hole 11 will be required as compared to other areas of surface 12. Referring to FIG. 3(A), if the solvent comprises water alone or an alcohol alone, then the walls of the through hole 11 will only have a partial real image 13 and will only be partially metallized resulting in a discontinuous metal deposit 14. Such a discontinuous deposit cannot be tolerated in printed circuit fabrication. Accordingly, it has surprisingly been found that such a discontinuity can be eliminated by employing as the solvent a mixture comprising an alcohol and water whereby a void-free, continuous electroless metal deposit 15 is obtained, as illustrated in FIG. 3(B). However, a criticality in the type of alcohol employed has also been found, namely that only by employing an alcohol containing at least 2 carbon atoms and ranging up to 8 carbon atoms will continuous deposit 15 be obtained. The concentration of the alcohol employed in the solvent is from 0.1 weight percent ranging up to a maximum of up to and including 50 weight percent, where the alcohol has at least three carbon atoms. In the case of ethanol, a criticality has been found in the concentration, namely that at least 5 weight percent of ethanol must be employed, otherwise a discontinuous deposit 14 [FIG. 3(A)] will be obtained.

Suitable electroless metal deposition solutions are well known in the art and will not be elaborated herein. Reference in this regard is made to the patents incorporated hereinto by reference, which disclose some suitable electroless metal deposition solutions.

The electroless metal deposit 15 [FIG. 3(B)] may be built up to a desired thickness by prolonged exposure to the electroless metal deposition solution or, alternatively, may be further built up by being electroplated in a standard electroplating bath. Again, the various typical electroplating solutions, plating conditions and procedures are well known in the art and will not be elaborated herein. Again, reference in this regard is made to U.S. Pat. Nos. 3,772,056; 3,772,078; 3,907,621; 3,925,578; and 3,930,963, incorporated hereinto by reference.

It is of course to be understood that substrate 10, including the walls of through hole 11, may be blanket metallized. Substrate 10 being dip coated with the sensitizing solution comprising at least the reducible metal salt. The coated substrate is then exposed to either heat, radiant energy, e.g., ultraviolet radiation, or a reducing agent to form a catalytic surface. The catalytic surface is then electrolessly metal deposited. If it is desired to pattern the metal deposit, conventional subtractive techniques can be employed, such as conventional masking and etching techniques.

EXAMPLE I

A substrate comprising a steel core with a fully cured diglycidyl ether of bisphenol A coating thereon was selected. The substrate comprised about 200 through holes having a diameter of about 0.050 inch. The substrate was immersed in a solvent bath comprising methyl ethyl ketone for ten minutes at 25° C. The substrate was water rinsed for one minute at 25° C and then etched in an aqueous solution comprising 360 grams $CrO_3$, 250 grams $H_3PO_4$ and 180 grams $H_2SO_4$ in 1000 ml. of water, maintained at 25° C for ten minutes. The etched substrate was then water rinsed at 25° C. for ten minutes.

A sensitizing solution was prepared by dissolving 21.5 grams of cupric formate, 16 grams of 2,6-anthraquinone disulfonic acid disodium salt and 66 grams of sorbitol in a solvent comprising 1000 ml. of water. The etched substrate was immersed in the sensitizing solution for one minute at 25° C., removed therefrom and dried at 90° to 100° C. for three minutes. A surface of the dried substrate was selectively exposed to a high-pressure mercury discharge lamp (30 watts/$cm^2$ surface at 3660A.) for 90 seconds to form a real image. The exposed surface was water rinsed for one minute and then immersed in a conventional electroless metal deposition solution comprising cupric sulfate, formaldehyde, sodium cyanide, alkali and EDTA, to obtain a 1.4 mil electroless copper-deposited pattern corresponding to the real image. The resultant electroless copper pattern was discontinuous on the walls of the through holes.

EXAMPLE II

The procedure of Example I was repeated except that the sensitizing solution comprised only a methanol solvent. Electroless metallization could not be obtained.

EXAMPLE III

The procedure of Example I was repeated except that a plurality of sensitizing solutions was employed on a plurality of substrates. The sensitizing solutions comprised aqueous methanol solvents having a range of concentration. The methanol concentration ranged from 0.1 weight percent to 45 weight percent of the solvent solution at 25° C. Substantially the same results were obtained as of Example I.

EXAMPLE IV-A

The procedure of Example I was repeated except that the sensitizer solution comprised as the solvent 1000 ml. of an aqueous ethanol solution comprising less than 50 grams of ethanol therein. Substantially the same results of Example I were obtained.

The following Examples IV-B through XI illustrate electroless metal deposition of the substrate whereby the walls of the through holes were metallized with a continuous metal layer.

EXAMPLE IV-B

The procedure of Example IV-A was repeated except that the solvent comprised 50 grams of ethanol therein. A 1.4 mil copper deposit was obtained and there were no discontinuous copper deposits on the walls of the through holes.

EXAMPLE V

A. The procedure of Example IV-A was repeated except that the solvent comprised an aqueous solution containing 0.1 weight percent of n-propanol therein.

B. The procedure 4*f* Example V-A was repeated except that the aqueous solvent contained 50 weight percent n-propanol.

EXAMPLE VI

A. The procedure of Example IV-A was repeated except that the solvent comprised an aqueous solution containing 0.1 weight percent of n-butanol therein. A continuous 1.4 mil copper deposit was obtained.

B. The procedure of Example VI-A was repeated except that the aqueuos solvent was saturated with n-butanol at 25° C. (7.5 weight percent). A continuous copper deposit was obtained.

EXAMPLE VII

A. The procedure of Example IV-A was repeated except that the solvent comprised an aqueous solution containing 0.1 weight percent of tertiary-butanol therein. A continuous 1.4 mil copper deposit was obtained.

B. The procedure of Example VII-A was repeated except that the aqueous solvent contained 50 weight percent of tertiary-butanol. A continuous 1.4 mil copper deposit was obtained.

EXAMPLE VIII

A. The procedure of Example IV-A was repeated except that the solvent comprised an aqueous solution containing 0.1 weight percent of n-pentanol therein. A continuous 1.4 copper deposit was obtained.

B. The procedure of Example VIII-A was repeated except that the aqueous solvent was saturated with n-pentanol at 25° C. (2.8 weight percent). A continuous 1.4 mil copper deposit was obtained.

EXAMPLE IX

A. The procedure of Example IV-A was repeated except that the solvent comprised an aqueous solution containing 0.1 weight percent of n-hexanol therein. A continuous 1.4 mil copper deposit was obtained.

B. The procedure of Example IX-A was repeated except that the aqueous solvent was saturated with n-hexanol at 25° C. (0.6 weight percent). A continuous 1.4 mil copper deposit was obtained.

EXAMPLE X

A. The procedure of Example IV-A was repeated except that the solvent comprised an aqueous solution containing 0.1 weight percent of n-heptanol. A continuous 1.4 mil copper deposit was obtained.

B. The procedure of Example X-A was repeated except that the aqueous solvent was saturated with n-heptanol at 25° C. (0.2 weight percent). A continuous 1.4 mil copper deposit was obtained.

EXAMPLE XI

A. The procedure of Example IV-A was repeated except that the solvent comprised an aqueous solution containing 0.01 weight percent n-octanol. A continuous 1.4 mil copper deposit was obtained.

B. The procedure of Example XI-A was repeated except that the aqueous solvent was saturated with n-octanol at 25° C. (0.5 weight percent). A continuous 1.4 mil copper deposit was obtained.

EXAMPLE XII

A. The procedure of Example VI-A was repeated except that the solution comprised (1) an aqueous solvent containing 5.0 weight percent n-butanol; (2) 25 grams per liter of solvent of cupric formate; and (3) 70 grams per liter of solvent of sorbitol. The substrate surface was exposed to the source of ultraviolet radiation for a period of time sufficient to reduce the cupric ions to copper metal nuclei. This period of time was 90 seconds, whereby an adequate real image was obtained on the substrate surface.

B. The procedure of Example XII-A was repeated except that the sensitizing solution comprised in addition 25 parts per million of potassium ferrithiocyanide. The exposure time needed to obtain an adequate real image was 30 seconds.

C. The procedure of Example XII-B was repeated except that the concentration of the potassium ferrithiocyanide was 50 parts per million. Substantially the same results were obtained.

D. The procedure of Example XII-B was repeated except that the potassium ferrithiocyanide was present in an amount of 75 parts per million. After a 30-second exposure the resultant image was very light and unacceptable.

E. The procedure of Example XII-B was repeated except that the potassium ferrithiocyanide was present in an amount of 150 parts per million. A 30-second exposure gave a barely visible image.

EXAMPLE XIII

A. The procedure of Example VII-A was repeated except that the solution comprised (1) an aqueous solvent containing 5.0 weight percent n-butanol; (2) 25 grams per liter of solvent of cupric formate; and (3) 66 grams per liter of solvent of sorbitol. The resultant real image formed on the substrate surface was aged for 24 hours at 25° C and a relative humidity of 45%. The real image faded and disappeared. Upon immersion of the substrate into the electroless metal deposition solution, an electroless metal deposit was not obtained.

B. The procedure of Example XIII-A was repeated except that the solution comprised 33 grams of sorbitol per liter of solvent and 33 grams of lactose per liter of solvent. The substrate surface containing the real image was aged for about one month at 25° C and 76% relative humidity. The real image did not disappear and a 1.4 mil electroless copper deposit was obtained thereon.

C. The procedure of Example XIII-B was repeated except that the solution did not contain sorbitol as a secondary reducer but 66 grams per liter of solvent of lactose. Substantially the same results as of Example XIII-B were obtained.

EXAMPLE XIV

A. The procedure of Example XIII-A was repeated except that prior to the radiant energy exposure, the resultant sensitized surface was aged for 24 hours at 25° C at a relative humidity of 45%. The aged surface was then exposed to the radiant energy source. A real image was not visually observed. Upon exposure to the electroless metal deposition solution, an electroless metal deposit was not obtained.

B. The procedure of Example XIII-B was repeated except that prior to the radiant energy exposure, the resultant sensitized surface was aged for one month at 25° C and a relative humidity of 76%. The aged surface was then selectively exposed to the radiant energy and a real image was visually observed. Upon exposure to the electroless metal solution, a 1.4 mil electroless copper deposit was obtained on the real image.

C. The procedure of Example XIII-C was repeated except that prior to the radiant energy exposure, the resultant sensitized surface was aged for 24 hours at 25° C and a 76% relative humidity. The aged surface was then selectively exposed to the radiant energy and a real image was visually observed. Upon exposure to the electroless metal deposition solution, a 1.4 mil electroless copper deposit was obtained on the real image.

EXAMPLE XV

A. The procedure of Example VII-A was repeated except that the sensitizing solution contained 60 grams of lactose which was the only secondary reducer employed. The sensitized surface was dried at 95° C. for three minutes prior to exposure to the radiant energy source. A real image was not obtained. Upon exposure to the electroless metal disposition solution, an electroless metal deposit was not obtained.

B. The procedure of Example XV-A was repeated except that the sensitized surface was not dried prior to exposure to the source of radiant energy. A real image was obtained as well as a 1.4 mil electroless copper deposit thereon.

It is to be understood that the abovedescribed embodiments are simply illustrative of the principles of the invention. Various other modifications and changes may be made by those skilled in the art which will embody the principles of the invention and fall within the spirit and scope thereof.

What is claimed is:

1. A method of depositing a metal on a surface of a substrate including the walls of at least one aperture contained in the substrate, which comprises:

(a) coating the surface with a sensitizing solution comprising at least a reducible salt of a non-noble metal dissolved in a binary solvent, for providing a continuous metal deposit on the walls, consisting essentially of water and an alcohol having a structural formula of

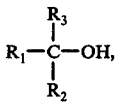

where $R_1$, $R_2$, and $R_3$ are members selected from the group consisting of an alkyl group having 1 to 7 carbon atoms and the hydrogen atom, where said alcohol has a total of 2 to 8 carbon atoms and where said alcohol is present in an amount of at least 5 weight percent when said alcohol has two carbon atoms and in an amount of at least 0.1 weight percent when said alcohol has more than two carbon atoms; and (b) treating said coated surface by (1) drying it and exposing it to a source of light radiant energy or (2) exposing it to a chemical reducing agent or (3) heating it to reduce said metal salt to metallic nuclei to form a catalytic layer thereon capable of directly catalyzing the deposition of a metal on said nuclei from an electroless metal deposition solution.

2. The method as defined in claim 1 which further comprises exposing said catalytic layer to an electroless metal deposition solution to deposit an electroless metal deposit thereon.

3. The method as defined in claim 1 wherein said alcohol has two carbon atoms and is present in an amount ranging from at least 5 weight percent to 50 weight percent.

4. The method as defined in claim 1 wherein the substrate comprises a dielectric material.

5. The method as defined in claim 1 wherein the substrate comprises a metal-clad laminate.

6. The method as defined in claim 1 wherein in step (b) said treating to reduce said salt comprises exposing said coated surface to a source of light radiant energy.

7. The method as defined in claim 6 wherein said sensitizing solution comprises said metal salt, a radiation-sensitive reducing agent for said salt and a secondary reducer.

8. The method as defined in claim 7 wherein said reducing agent is a light-sensitive reducing compound selected from the group consisting of ferric salts, dichromates, anthraquinone disulfonic acids and salts, glycine and L-asorbic acid.

9. The method as defined in claim 8 wherein said secondary reducer comprises a suitable polyhydroxy alcohol.

10. The method as defined in claim 9 wherein said secondary reducer comprising said suitable polyhydroxy alcohol is combined with a second polyhydroxy alcohol which comprises lactose.

11. The method as defined in claim 8 wherein said radiation-sensitive reducing agent comprises anthraquinone 2,6-disulfonic acid disodium salt.

12. The method as defined in claim 11 wherein said sensitizing solution also comprises a metal accelerator comprising stannous chloride.

13. The method as defined in claim 12 wherein said sensitizing solution also comprises citric acid and a polyhydroxy alcohol secondary reducer selected from the group consisting of glycerine, sorbitol, pentaerythritol and mesoerythritol.

14. The method as defined in claim 1 wherein said salt is a reducible salt of an element selected from the group consisting of copper, nickel, cobalt and iron.

15. The method as defined in claim 14 wherein said sensitizing solution comprises in addition a metal accelerator.

16. The method as defined in claim 15 wherein said metal accelerator comprises a ferrithiocyanide compound.

17. The method as defined in claim 1 wherein in step (b) said treating to reduce said salt comprises exposing said coated surface to a chemical reducing agent.

18. The method as defined in claim 17 wherein said sensitizing solution comprises said metal salt and an auxiliary reducing agent.

19. The method as defined in claim 17 wherein said sensitizing solution comprises said metal salt and a metal accelerator.

20. The method as defined in claim 1 wherein in step (b) said treating to reduce said salt comprises heating said coated surface to attain a thermal reduction.

21. The method as defined in claim 20 wherein said sensitizing solution comprises said metal salt and an auxiliary reducing agent.

22. The method as defined in claim 1 wherein said alcohol comprises n-butanol.

23. The method as defined in claim 1 wherein said alcohol has three carbon atoms and is present in an amount ranging from 0.1 weight percent to 50 weight percent.

24. A method for selectively metallizing a dielectric surface of a substrate having at least one aperture therein comprising the steps of:

(a) depositing on the surface a layer of a sensitizing composition by treating the surface with a solution comprising at least a reducible salt of a non-noble metal dissolved in a binary solvent, for providing an essentially void-free metallization on the walls of the aperture, consisting essentially of water and an alcohol having a structural formula of

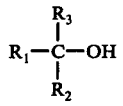

where $R_1$, $R_2$, and $R_3$ are members selected from the group consisting of an alkyl group having 1 to 7 carbon atoms and the hydrogen atom, where said alcohol has a total of 2 to 8 carbon atoms and where said alcohol is present in an amount of at least 5 weight percent when said alcohol has two carbon atoms and in an amount of at least 0.1 weight percent when said alcohol has more than two carbon atoms; and (b) treating said layer by (1) drying it and exposing it to a source of light radiant energy or (2) exposing it to a chemical reducing agent or (3) heating it to reduce said metal salt to metallic nuclei thereof, and wherein at least one of said treating steps (a) or (b) above, is restricted to a selected pattern on the surface to produce a real image of the metallic nuclei in the selected pattern which is capable of directly catalyzing the deposition thereon of a metal from an electroless metal deposition solution.

25. The method as defined in claim 24 which further comprises exposing the real image to an electroless metal deposition solution to deposit an electroless metal deposit thereon.

26. The method as defined in claim 24 wherein said salt is of the group consisting of reducible copper, nickel, cobalt and iron salts.

27. The method as defined in claim 24 wherein in step (b) said treating to reduce said salt comprises exposing said layer-deposited surface to a source of light radiant energy.

28. The method as defined in claim 27 wherein said metal salt is reduced to metallic nuclei by selective exposure to light.

29. The method as defined in claim 28 wherein said metal salt is reduced to metallic nuclei by selective exposure to ultraviolet radiation.

30. The method as defined in claim 27 wherein said sensitizing solution comprises the reducible metal salt, a radiation-sensitive reducing agent for said salt and a secondary reducer.

31. The method as defined in claim 30 wherein said reducing agent is a light-sensitive reducing compound of the group consisting of ferric salts, dichromates, anthraquinone disulfonic acids and salts, glycine and L-ascorbic acid.

32. The method as defined in claim 30 wherein said sensitizing solution also comprises a metal accelerator.

33. The method as defined in claim 32 wherein said metal accelerator comprises a ferrithiocyanide compound.

34. The method as defined in claim 32 wherein said metal accelerator comprises stannous chloride.

35. The method as defined in claim 30 wherein said secondary reducer comprises a suitable polyhydroxy alcohol.

36. The method as defined in claim 35 wherein said secondary reducer comprising said suitable polyhydroxy alcohol is combined with a second polyhydroxy alcohol which comprises lactose.

37. The method as defined in claim 35 wherein said sensitizing solution also comprises citric acid and said secondary reducer comprises a polyhydroxy alcohol selected from the group consisting of glycerine, sorbitol, pentaerythritol and mesoerythritol.

38. The method as defined in claim 30 wherein said radiation-sensitive reducing agent comprises anthraquinone 2,6-disulfonic acid sodium salt.

39. The method as defined in claim 24 wherein in step (b) said treating to reduce said metal salt comprises exposing said layer-deposited surface to a chemical reducing agent.

40. The method as defined in claim 24 wherein in step (b) said treating to reduce said salt comprises heating said coated surface to attain a thermal reduction.

41. The method as defined in claim 24 wherein said alcohol comprises n-butanol.

42. The method as defined in claim 24 wherein said alcohol has two carbon atoms and is present in an amount ranging from at least 5 weight percent to 50 weight percent.

43. The method as defined in claim 24 wherein said alcohol has three carbon atoms and is present in an amount ranging from 0.1 weight percent to 50 weight percent.

44. A method for making printed circuit boards having at least one through hole therein, which comprises:

(a) treating an electrically non-conductive base with a solution comprising a reducible salt of a non-noble metal, selected from the group consisting of reducible salts of copper, nickel, cobalt and iron, a light radiation-sensitive reducing compound and a secondary reducer, dissolved in a binary solvent, for providing an essentially void-free metallization on the walls of the aperture, consisting essentially of water and an alcohol having a structural formula of

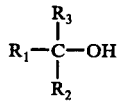

where $R_1$, $R_2$, and $R_3$ are members selected from the group consisting of an alkyl group having 1 to 7 carbon atoms and the hydrogen atom, where said alcohol has a total of 2 to 8 carbon atoms and where said alcohol is present in an amount of at least 5 weight percent when said alcohol has two carbon atoms and in an amount of at least 0.1 weight percent when said alcohol has more than two carbon atoms; and (b) drying said treated base;

(c) exposing said dried base to light radiant energy in selected areas including the walls of the through hole to produce metallic nuclei in the form of a real image corresponding to the desired circuit pattern;
(d) rinsing said exposed base to remove unexposed metal salts; and
(e) exposing said real image to an electroless metal deposition solution to deposit an electroless metal thereon.

45. The method as defined in claim 44 wherein said secondary reducer comprises an organic hydroxy compound selected from an alcohol and a suitable polyol.

46. The method as defined in claim 45 wherein said organic hydroxy compound is selected from the group consisting of glycerol, sorbitol, pentaerythritol and a mixture thereof.

47. The method as defined in claim 44 wherein in step (a) said solution comprises a ferrithiocyanide compound metal-reduction accelerator.

48. The method as defined in claim 44 wherein said alcohol comprises n-butanol.

49. The method as defined in claim 44 wherein the electrically non-conducting base is clad with a thin metal laminate and the aperture is formed therethrough prior to providing the base with the real image.

50. The method as defined in claim 44 wherein said alcohol has two carbon atoms and is present in an amount ranging from at least 5 weight percent to 50 weight percent.

51. The method as defined in claim 44 wherein said alcohol has three carbon atoms and is present in an amount ranging from 0.1 weight percent to 50 weight percent.

52. A method of depositing a metal on a surface of a substrate comprising the steps of:

(a) treating the surface with a light radiation-sensitive solution comprising a reducible salt of a non-noble metal, selected from the group consisting of copper, nickel, cobalt and iron, a radiation-sensitive reducing agent for said salt and a secondary reducer consisting essentially of lactose, dissolved in a binary solvent, consisting essentially of water and an alcohol having a structural formula of

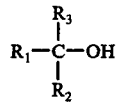

where $R_1$, $R_2$, and $R_3$ are members selected from the group consisting of an alkyl group having 1 to 7 carbon atoms and the hydrogen atom, where said alcohol has a total of 2 to 8 carbon atoms and where said alcohol is present in an amount of at least 5 weight percent when said alcohol has two carbon atoms and in an amount of at least 0.1 weight percent when said alcohol has more than two carbon atoms; and (b) exposing at least a portion of said solution treated surface, prior to drying thereof, to a source of light radiant energy for a period of time sufficient to reduce the metal salt to metallic nuclei thereof which are capable of directly catalyzing the deposition thereon of a metal from an electroless metal deposition solution.

53. A method of depositing a metal pattern on a surface of a substrate which comprises:

(a) treating the surface with a solution comprising a reducible salt of a non-noble metal selected from the group consisting of reducible salts of copper, nickel, cobalt and iron, a radiation-sensitive reducing compound, and a suitable secondary reducer combined with a real image stabilizer comprising lactose;
(b) drying said treated surface; and
(c) selectively exposing said dried surface to a source of light radiant energy, wherein the improvement comprises:

in step (a) the solution additionally comprises a real image former and stabilizer comprising lactose which permits the formation of metallic nuclei to form a stable real image.

* * * * *

UNITED STATES PATENT OFFICE

CERTIFICATE OF CORRECTION

PATENT NO. : 4,098,922

DATED : July 4, 1978

INVENTOR(S) : D. Dinella-J. A. Emerson-T. D. Polakowski, Jr.

It is certified that error appears in the above-identified patent and that said Letters Patent are hereby corrected as shown below:

In the specification, Column 4, line 45, "heatactivation" should read --heat-activation--. Column 6, line 34, "here" should read --hereat--. Column 13, line 32, "abovedescribed" should read --above-described--.

In the claims, claim 53, column 18, lines 36-41, "energy, wherein the improvement comprises:
in step (a) the solution additionally comprises a real image former and stabilizer comprising lactose which permits the formation of metallic nuclei to form a stable real image" should read --energy to form a stable real image.--.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*